US005104164A

United States Patent [19]

Sieg

[11] Patent Number: 5,104,164

[45] Date of Patent: Apr. 14, 1992

[54] LOCK WITH FACILITY FOR PREVENTING UNAUTHORIZED ENTRY

[75] Inventor: Giselher Sieg, Erftstadt, Fed. Rep. of Germany

[73] Assignee: DOM-Sicherheitstechnik GmbH & Co. KG, Fed. Rep. of Germany

[21] Appl. No.: 535,449

[22] Filed: Jun. 8, 1990

[30] Foreign Application Priority Data

Jun. 15, 1989 [DE] Fed. Rep. of Germany ..... 3919568

[51] Int. Cl.[5] ..... E05B 15/02

[52] U.S. Cl. ..... 292/336.3; 292/DIG. 66; 292/36; 70/DIG. 10; 70/483; 70/369

[58] Field of Search ..... 292/7, DIG. 61, DIG. 66, 292/36, 336.3, 152, 39; 109/26, 32, 33, 68; 49/7-8, 395; 70/DIG. 10, 467, 470, 483

[56] References Cited

U.S. PATENT DOCUMENTS

| | | | |
|---|---|---|---|
| 1,269,311 | 6/1918 | Rixson | 292/36 |
| 2,942,449 | 6/1960 | White | 70/1.5 |
| 3,111,022 | 11/1963 | Maynard | 70/1.5 |
| 4,015,869 | 4/1977 | Horvath | 292/DIG. 66 |
| 4,065,164 | 12/1977 | Bartels | 292/347 |
| 4,183,565 | 1/1980 | Allemann | 292/DIG. 66 |
| 4,437,693 | 3/1984 | Godec | 49/8 |

FOREIGN PATENT DOCUMENTS

| | | | |
|---|---|---|---|
| 507145 | 11/1951 | Belgium | 292/36 |
| 2353721 | 4/1975 | Fed. Rep. of Germany | 292/36 |
| 319378 | 3/1902 | France | 292/152 |
| 2069588 | 8/1981 | United Kingdom | 292/36 |

*Primary Examiner*—Gary L. Smith
*Assistant Examiner*—Darnell Boucher
*Attorney, Agent, or Firm*—J. Bruce Hoofnagle

[57] ABSTRACT

The invention provides a lock with a forward and reverse action bolt element and a lock cylinder which precedes the operating region of the bolt element into which the force for shifting the bolt element is to be introduced. The lock comprises an arresting element which can be fused at least locally by the effect of heat on the lock cylinder and which, after fusion, arrests the bolt element against reverse lock actuation.

In an alternative embodiment, the lock may comprise a coupling between the operating region and a lock-actuating element spatially separated from it and protected by the lock cylinder, which coupling can be broken by fusion due to the effect of heat on the lock cylinder.

11 Claims, 6 Drawing Sheets

L
25
35
35
34
33
30
39
10
12
13
E
29
7
26
2

1
L
35
E
25
29
32
33
34
39
13
12
37
38
36
30
8
20
2
26

1
2
25
47
45
46
8
48
7
7
49
41
43
42
44
29
L
26

25
45
46
47
48
29
B
41
43
42
44
2
8
30
26
7
L

LOCK WITH FACILITY FOR PREVENTING UNAUTHORIZED ENTRY

BACKGROUND OF THE INVENTION

This invention relates to a lock with facility for preventing unauthorised entry and particularly relates to a lock having elements which are responsive to attempted unauthorised entry by use of a torch or similar heat-generating device for preventing operation of the lock thereafter.

A new method of making an unauthorised entry involves using a miniature welding torch to melt out the lock cylinder or lock tumbler mechanism associated with a lock so as to gain access to a bolt element of the lock. This method of entry is simplified by the fact that the lock cylinder or the lock tumblers are generally produced from brass alloys having a melting point of about 850° C. The bolt element is located in a bolt element operating region adjacent the lock cylinder or lock tumbler mechanism and, consists of steel having a melting point above 1000° C. and is not damaged during the melting process so that the lock can be opened relatively easily after the lock cylinder or the lock tumbler mechanism have been melted out.

SUMMARY OF THE INVENTION

An object of the present invention is to design a lock which is easy to produce such that the lock cannot be opened after a lock cylinder or lock tumblers have been melted out.

With these and other objects in mind, this invention contemplates a lock with facility for preventing unauthorised entry and includes a lock cylinder removably mounted within a door and a bolt element attached to the door for movement relative thereto. Means are provided for moving the bolt element with the means located adjacent the lock cylinder and concealed thereby. The lock cylinder is normally operable to facilitate removal thereof from the door to expose the moving means. An actuating element is provided for facilitating selective operation of the moving means to move the bolt element subsequent to removal of the lock cylinder from the door. Means, which is fusible at temperatures at or above a prescribed temperature, is provided for attaching the moving means to the bolt element at temperatures below the prescribed temperature and for detaching the moving means from the bolt element at temperatures at or above the prescribed temperature.

Other objects, features and advantages of the present invention will become more fully apparent from the following detailed description of the preferred and other embodiments, the appended claims and the accompanying drawings.

BRIEF DESCRIPTION OF THE DRAWINGS

Three embodiments of the invention are described below with reference to FIGS. 1 to 12.

DETAILED DESCRIPTION

Figure 1:
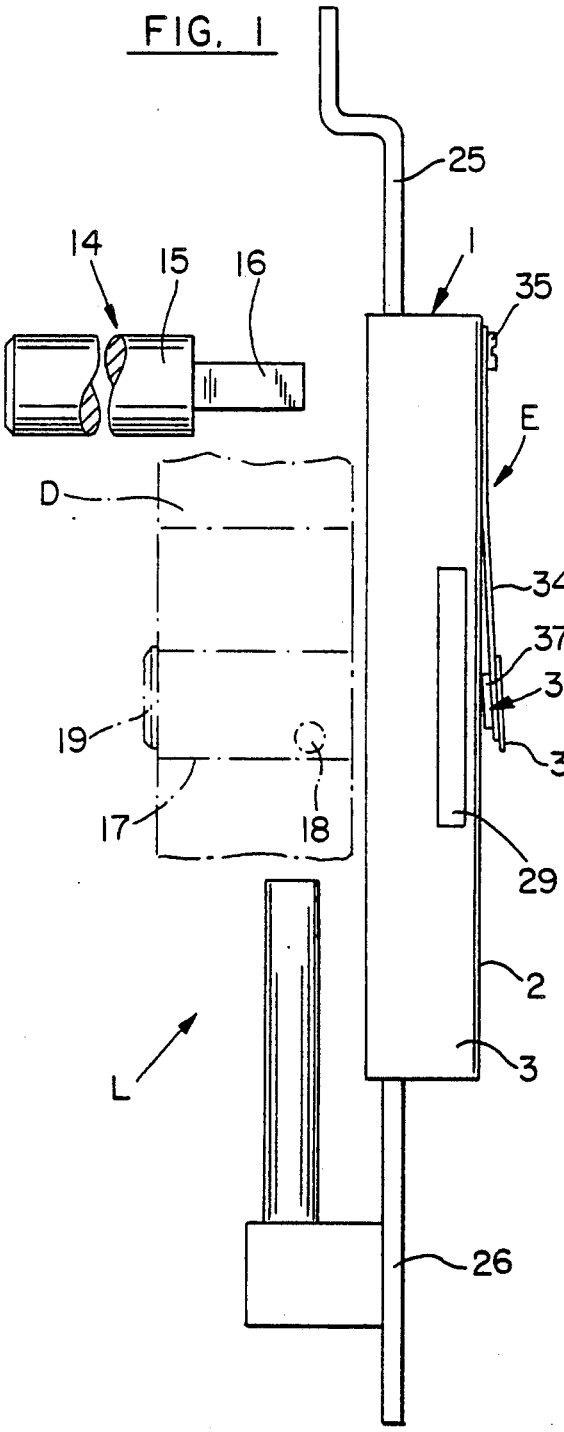
FIG. 1 is a side view of first embodiment a lock with associated lock cylinder (shown in phantom) and actuating element corresponding to the blocking position of the lock in the first embodiment.

A first and preferred embodiment of a lock L is illustrated in FIGS. 1 through 8 and is attached to a door D, shown in phantom. Lock L includes a box-shaped housing 1. Housing 1 consists of a lock base 2 with lock case lateral walls 3, 4, 5 and 6 and an opening of the lock base being covered by a lock cover 8 which is held by screws 7. The lock cover 8 extends parallel to the lock base 2 and is supported by internally threaded posts 9 which are mounted on and extend from an interior wall of the lock base and into which the screws 7 are threadedly mounted.

Figure 2:
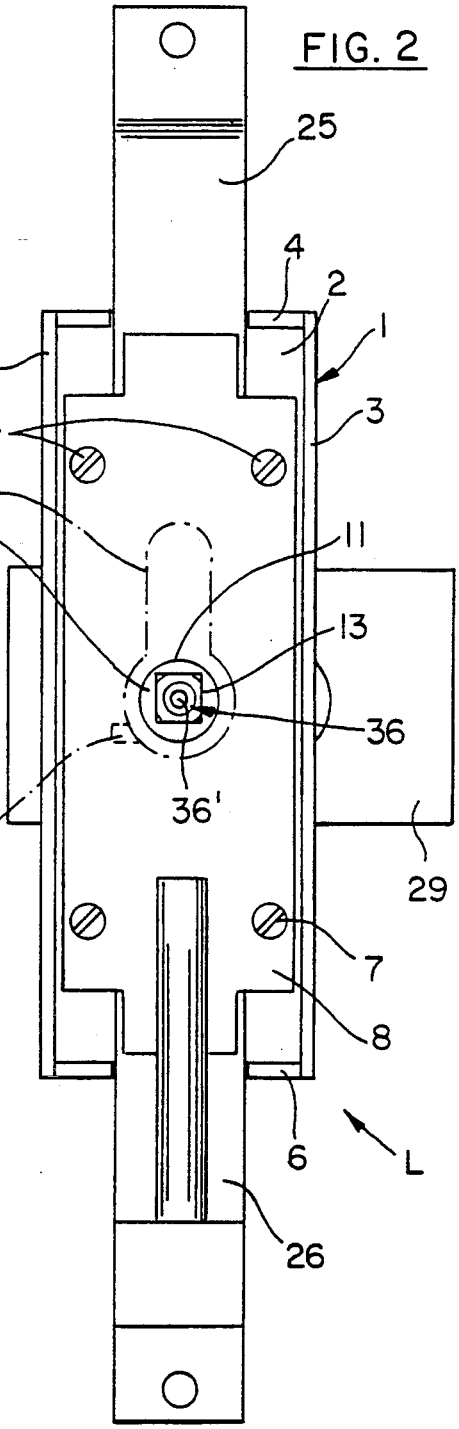
FIG. 2 is a front view of the lock, as seen from the lock cover.

The lock base 2 and the lock cover 8 have bearing openings 10 and 11 for a lock actuating nut 12 in their central region. This lock actuating nut 12 is provided with a central square opening 13. The lock actuating nut 12 with square opening 13 represents the operating region B for an actuating element 14. This actuating element 14 is formed with a round peg 15 which serves as a handle and a square peg 16 extending from the round peg 15. The cross section of the square peg 16 corresponds to that of the square opening 13. However, the actuating element 14 can only be inserted into the square opening 13 after a lock cylinder 17, which is shown in FIGS. 1 and 2 in phantom in assembly within the door D, has been removed from assembly with the door to reveal the square opening 13 of the lock actuating nut 12. In essence, the location of the lock cylinder 17 in the door D conceals the operating region B. The lock cylinder 17 is held in its operating position by a transverse bolt 18 which engages in a corresponding opening in the door D. A cylinder core 19 can be rotated by a key associated with the lock cylinder 17 such that the transverse bolt 18 is moved out of the opening in the door D and into the cylinder housing. The lock cylinder 17 can then be removed from within the door D to reveal the operating region B.

The square peg 16 can then be inserted through the opening of the door D formerly occupied by the lock cylinder 17 and into the square opening 13 of the lock actuating nut 12 for a purpose to be described hereinafter.

In the centre, the lock actuating nut 12 forms a collar 20. Two diametrically opposed slots 21, and 22 are formed in the collar 20 and are open at the edges of the collar for receipt thereon of a pair coupling pegs 23 and 24, respectively. These coupling pegs 23 and 24 extend from the ends of two bolt rods 25 and 26 which can be shifted vertically in opposite directions. The collar 20 also supports an entraining pin 27 which engages in a niche 28 in a slide bolt 29 guided in the lock case lateral wall 3 and 5. The niche 28 opens into a longitudinal slot 30 which extends in the direction of movement of the slide bolt 29 and into which the lock actuating nut 12 extends.

Figure 3:
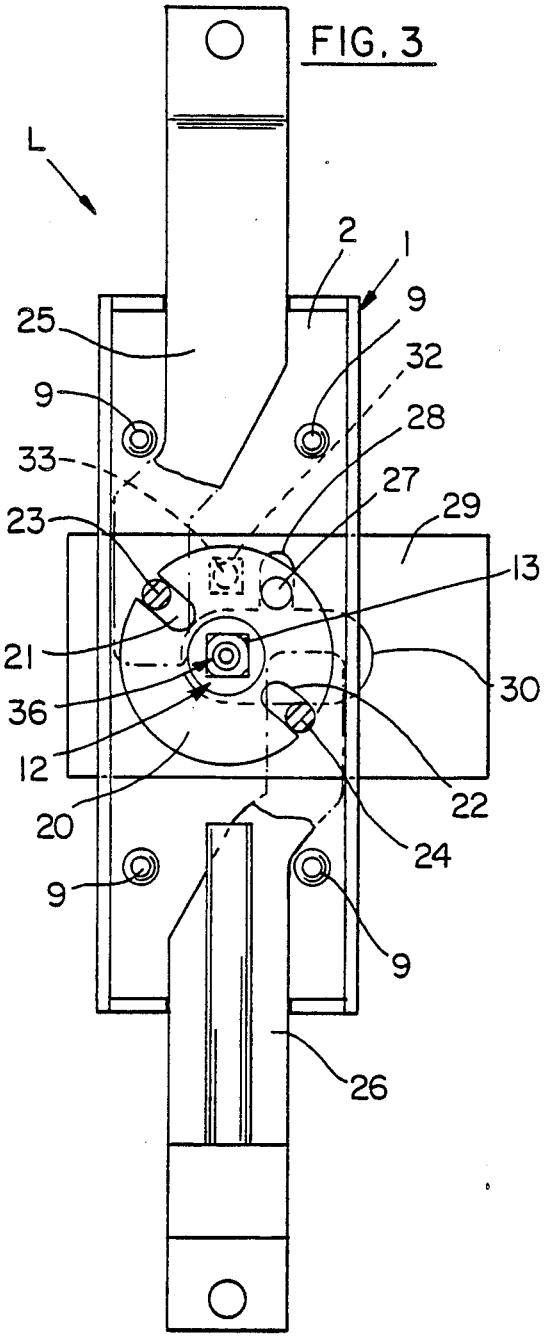
FIG. 3 is a front view corresponding to FIG. 2, in which the lock cover is omitted.
Figure 4:
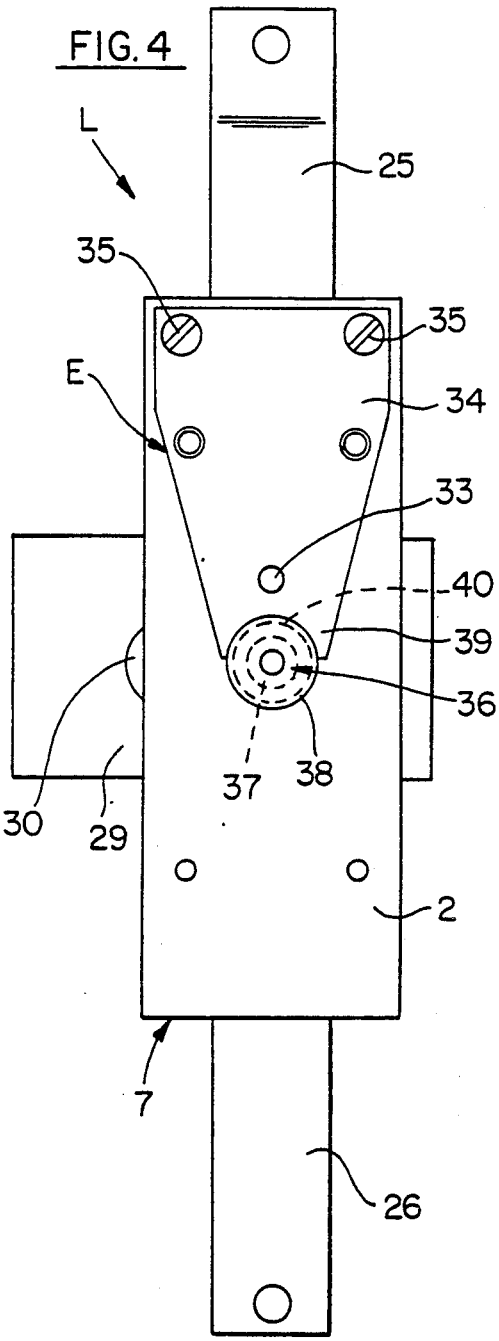
FIG. 4 is a rear view of the lock, as seen against the lock base.

To the side of the niche 28, the slide bolt 29 is provided with a recess 32. An arresting pin 33 extends through the lock base 2 and into the recess 32 when the slide bolt 29 is located in a blocking position and driving rods 25 and 26 are extended as illustrated in FIG. 3. In the blocking position, the arresting pin 33 prevents movement of the slide bolt 29. This arresting pin 33 is carried by an arresting element E which is constructed as a leaf spring 34 and is attached on the lock base 2 close to the lock case lateral wall 4 by means of screws 35. The free end of spring 34 tends to pivot and is urged in the direction of the lock base 2 and, at its free end, is formed with a contact face T, projecting into the operating region B, to be acted upon by the actuating element 14. In the embodiment illustrated, the contact face T is formed by the end face of a peg 36 which is attached fusibly by a soft solder joint 40 to the leaf spring 34. This peg 36 is positioned to extend into the square opening 13 in the lock actuating nut 12. The peg 36 is formed with a band 37 at one end thereof and of larger cross section with which the spring-loaded peg 36 rests on the opposing end face of the lock actuating nut 12, as can be seen in particular in FIG. 5. A stepped band 38 of even larger cross section, on whose is formed on the extreme end of the peg 36 adjacent the band 37. The leaf spring 34 is formed at the free end thereof with a downwardly open fork 39 which is positioned about the upper portion of the stepped band 38 of the peg 36 in semi-circular fashion. The fork 39 is attached to the inside wall of the band 38 by the soft solder joint 40 which represents a fusion position.

Figure 6:
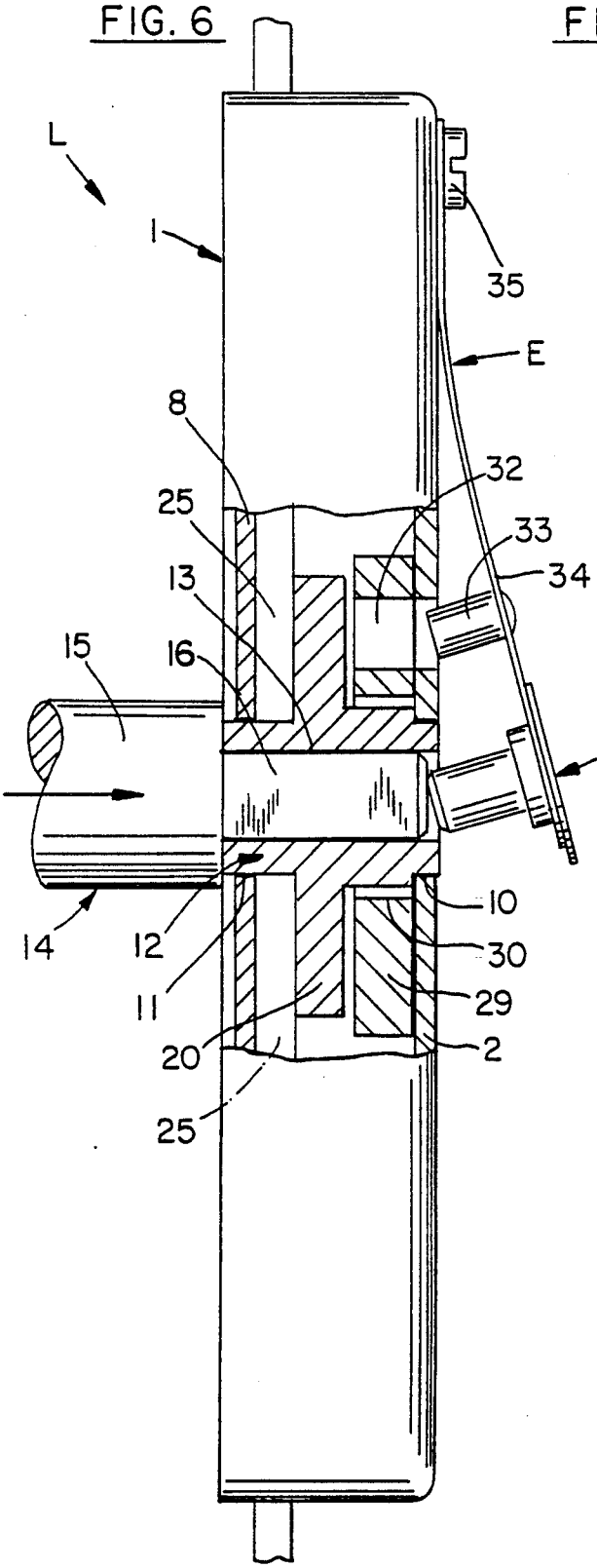
FIG. 6 is a side view, partly in elevation and partly in longitudinal section, of the lock after the lock cylinder has been removed according to instructions and the actuating element has been inserted, resulting in movement of the arresting pin to a non-blocking position.
Figure 5:
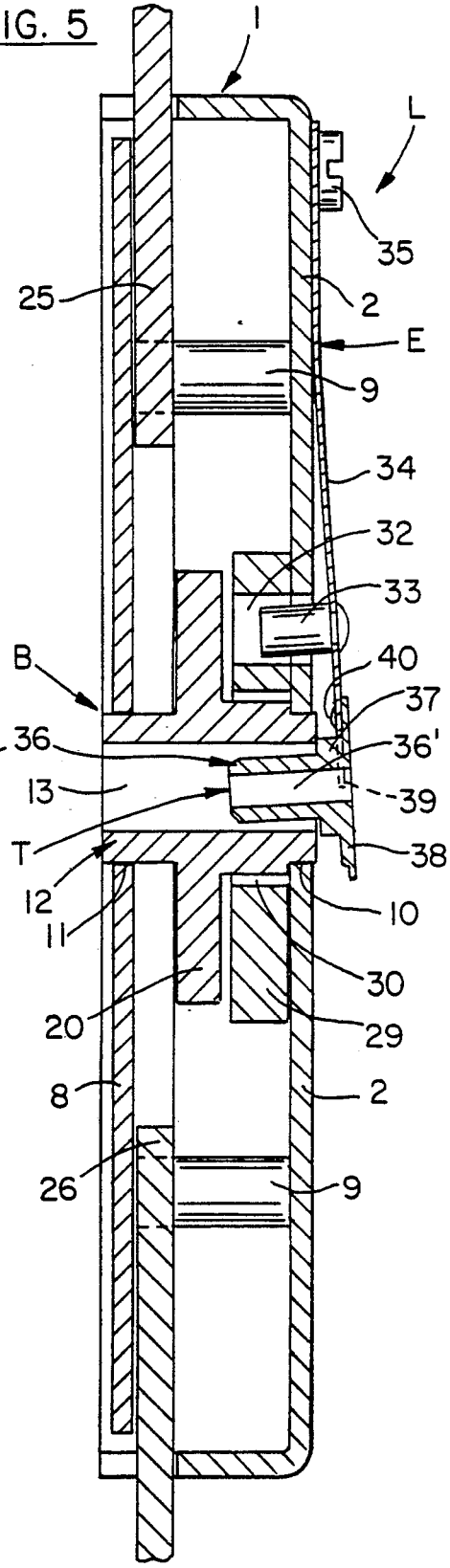
FIG. 5 is a longitudinal sectional view taken along lines 5—5 of FIG. 4 showing internal portions of the lock.
Figure 7:
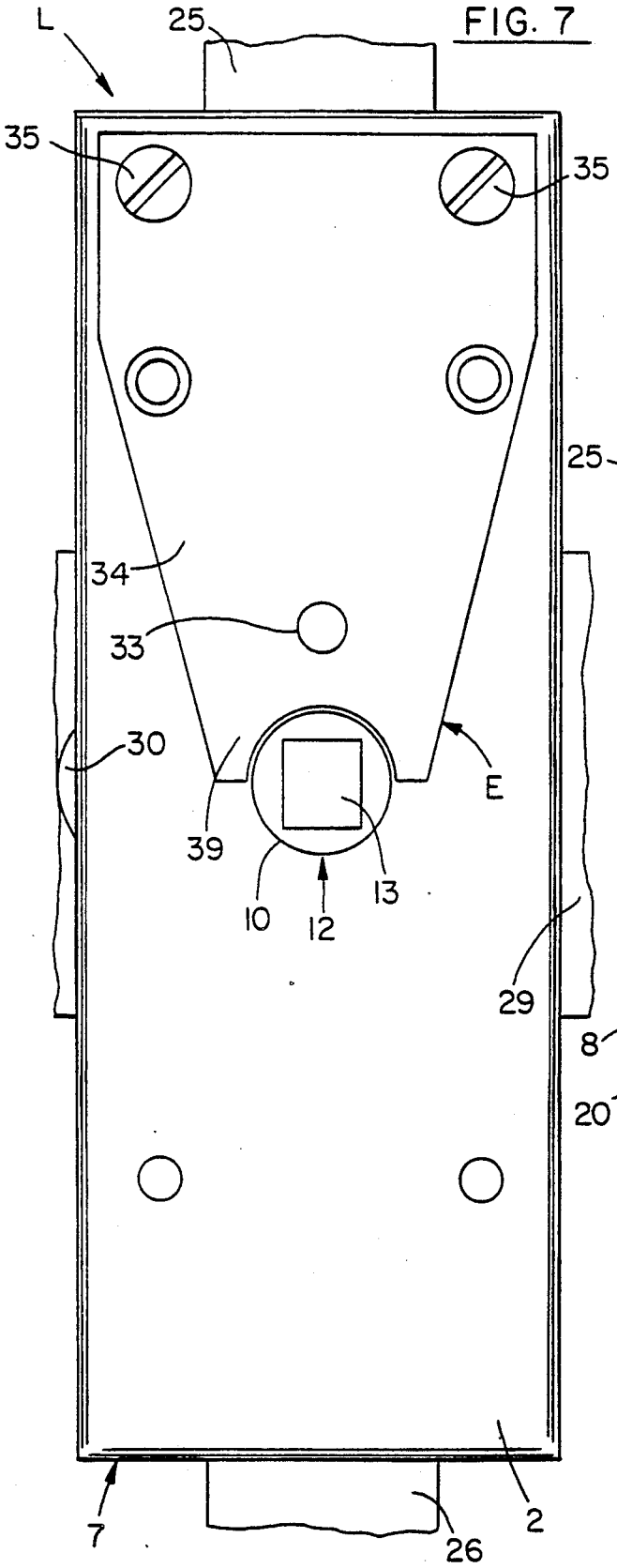
FIG. 7 is a rear view of the lock as seen in the direction of the lock base showing the rear of the lock after a peg has been detached from an arresting element due to the application of heat thereto.
Figure 8:
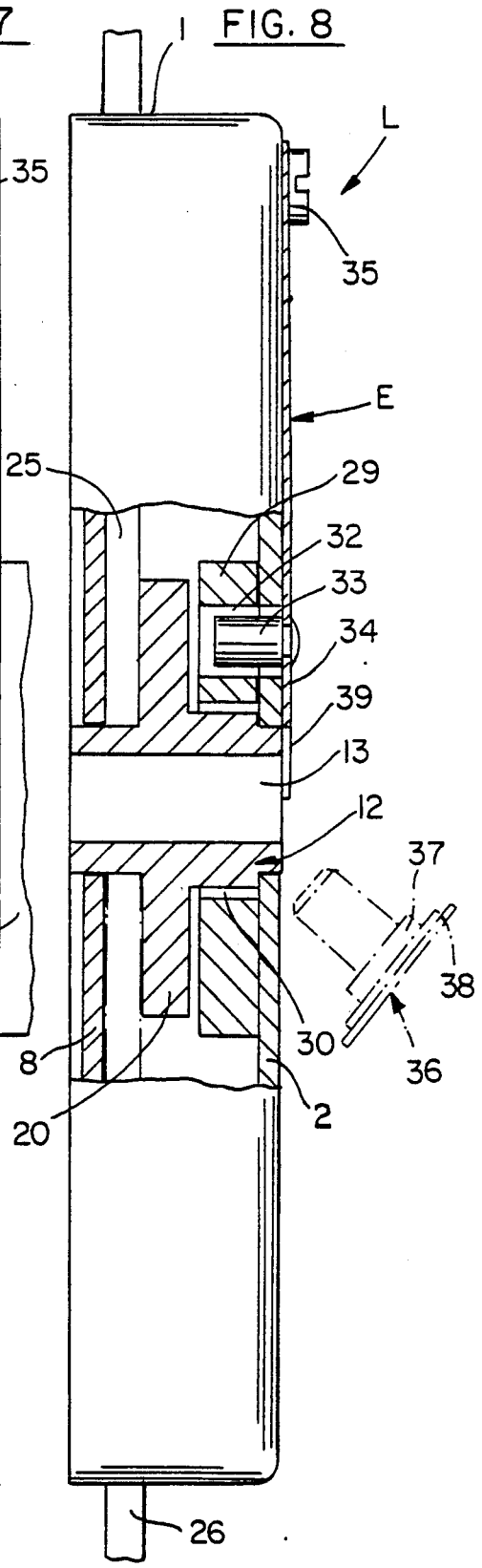
FIG. 8 is a side view of the lock with parts broken away to show some elements of the lock after the peg (which is shown in phantom) has been detached.

In order to open the door D in a normal fashion, the lock cylinder 17 firstly has to be removed using the associated key. The actuating element 14 is then used and its square peg 16 is inserted into the square opening 13 in the lock actuating nut 12, as can be seen in FIG. 6. During this insertion movement, the end face of the square peg 16 strikes the contact face T of the peg 36 which is provided with a continuous hole 36' (FIG. 5) and consequently pivots the leaf spring 34 so that the arresting pin 33 is moved out of the recess 32 in the slide bolt 29. Only then can the lock actuating nut 12 be rotated to permit the slide bolt 29 and the driving rods 25 and 26 are simultaneously shifted into the open position whereafter the door D may be opened.

The locking operation then takes place in the opposite direction.

During an attempted break-in using a miniature welding torch, the lock cylinder 17 can be destroyed or fused. However, the arresting element E which is locally fusible is moved into a blocking position by the action of heat being applied to the lock cylinder 17. In detail, the fusion position consisting of soft solder joint 40 is heated such that the peg 36 is detached from the leaf spring 34. The peg 36 can therefore drop out, as shown in phantom in FIG. 8. Due to the open fork 39 as formed at the free end of the leaf spring 34, the leaf spring itself does not lie in the region of the square opening 13, as shown particularly clearly in FIG. 7, and consequently prevents application of an opening tool against the leaf spring to facilitate removal of the arresting pin 33 from recess 32. As the peg 36 is released from the leaf spring 34, the leaf spring is moved into full flush engagement with the lock base 2. The arresting pin 33 also remains in the recess 32 of the slide bolt 29 or passes even more deeply into the recess 32. The lock actuating nut 12 cannot be turned using an opening tool because the slide bolt 29 is blocked. An attempted break-in is therefore effectively prevented.

Figure 9:
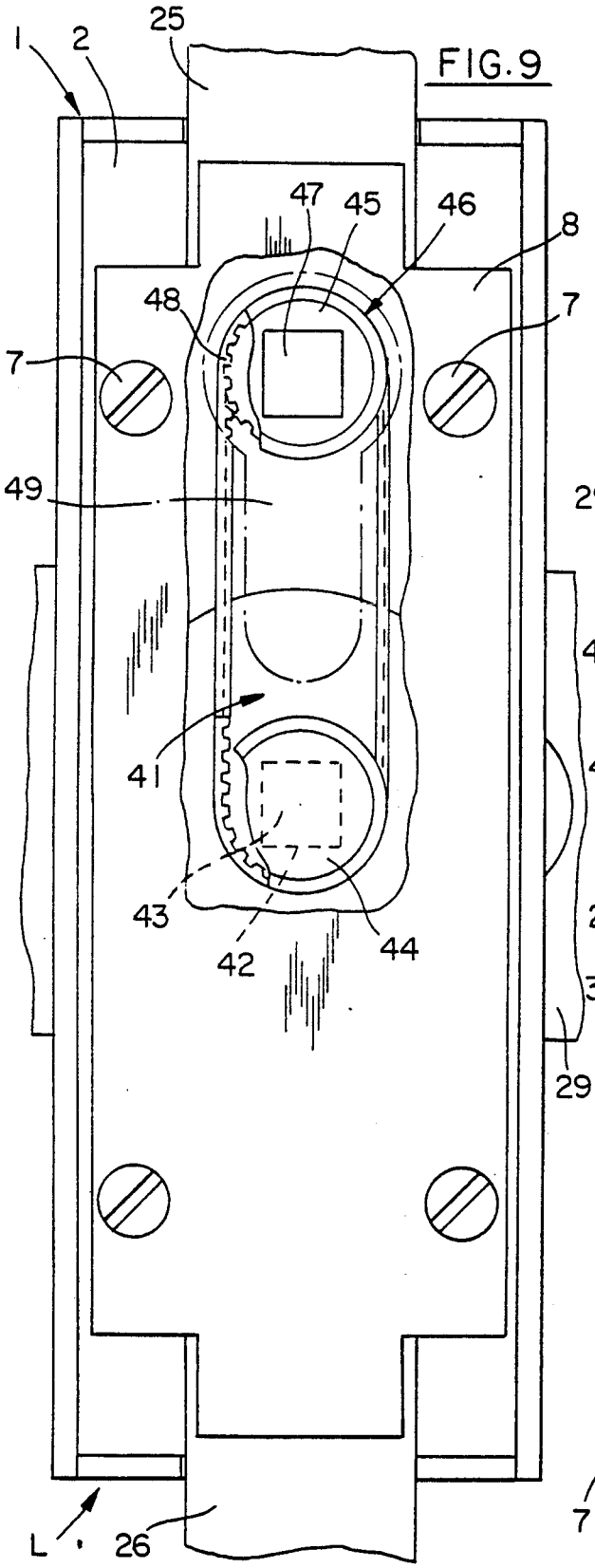
FIG. 9 is a front view of the lock as seen from the lock cover, relating to the second embodiment.
Figure 10:
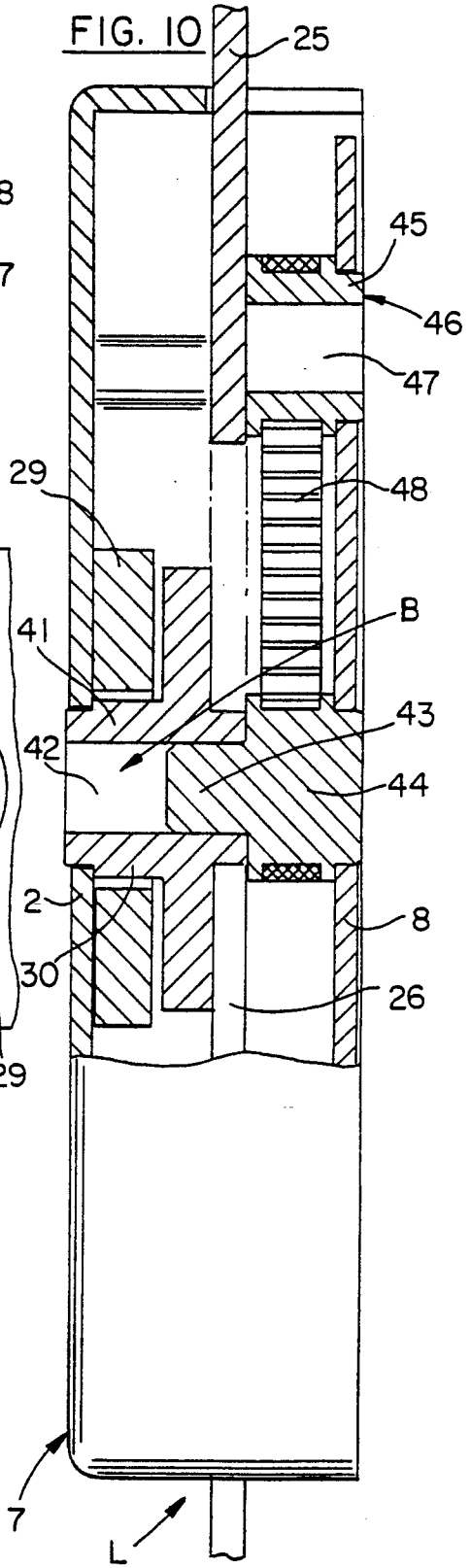
FIG. 10 is a partial longitudinal section through this lock.

The second embodiment shown in FIGS. 9 and 10 also relates to a lock with bolt rods 25 and 26 which can be moved in opposite directions and a slide bolt 29 which can be shifted transversely thereto, these components being controlled in equivalent ways.

A lock actuating nut 41 is positioned exclusively in the lock base 2 and has a square opening 42 formed axially therethrough. A square peg 43 is formed on and extends from a pinion wheel 44 which is mounted in the lock cover 8 with the square peg being located in the square opening 42. A pinion wheel 45 is mounted in the lock cover 8 spatially above the pinion wheel 44. The pinion wheel 45 forms a lock-actuating element 46 which is provided with a square opening 47 for receiving an actuating element, which corresponds to the actuating element 14 shown in FIG. 1.

The pinion wheels 44 and 45 are pulleys with teeth. An endless belt 48 of fusible material is placed about the spaced pinions 44 and 45. The belt 48 is also toothed and preferably consists of plastics material or rubber.

The lock-actuating element 46 is is positioned behind a lock cylinder 49 which is illustrated in phantom in FIG. 9. The lock cannot be actuated while the lock cylinder 49 is positioned in a door (such as door D of FIG. 1) and conceals the lock-actuating element 46. The square opening 47 is only cleared for insertion of an actuating element after the lock cylinder 49 has been removed.

During an attempted break-in using a miniature welding torch, heat is applied to the lock cylinder 49 whereby, when the temperature reaches or exceeds a prescribed level, the fusible belt 48 melts and the coupling formed by the fusible belt 48 between the operating region B and the lock-actuating element 46 is severed. Although the lock-actuating element 46 is accessible after melting of the belt 48, rotation of the lock-actuating element will not cause the lock actuating nut 41 to move the slide bolt 29.

Figure 11:
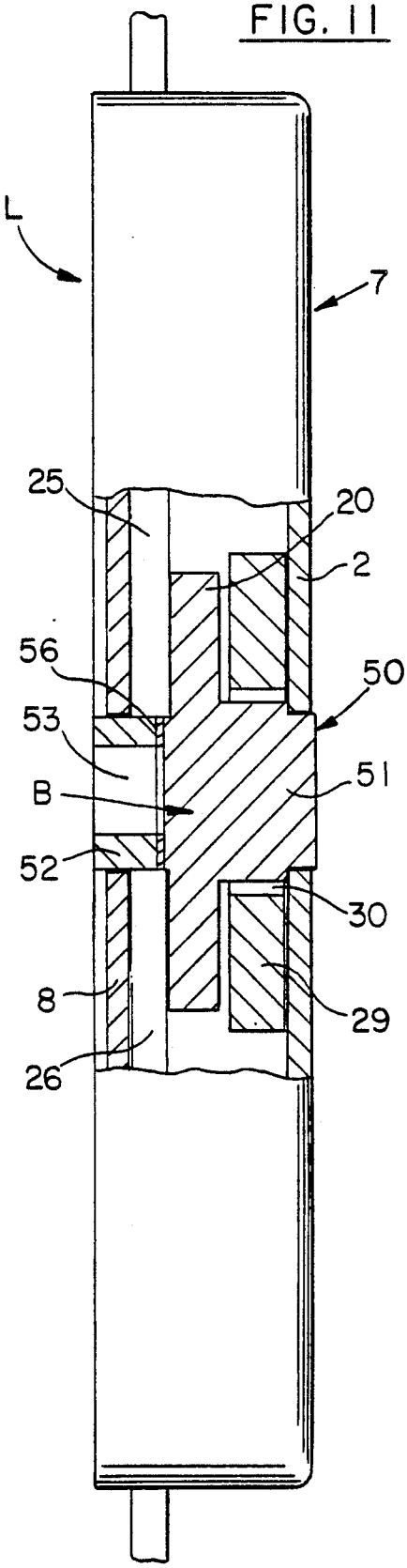
FIG. 11 is a view, partly in elevation and partly in longitudinal section, of the lock according to the third embodiment.
Figure 12:
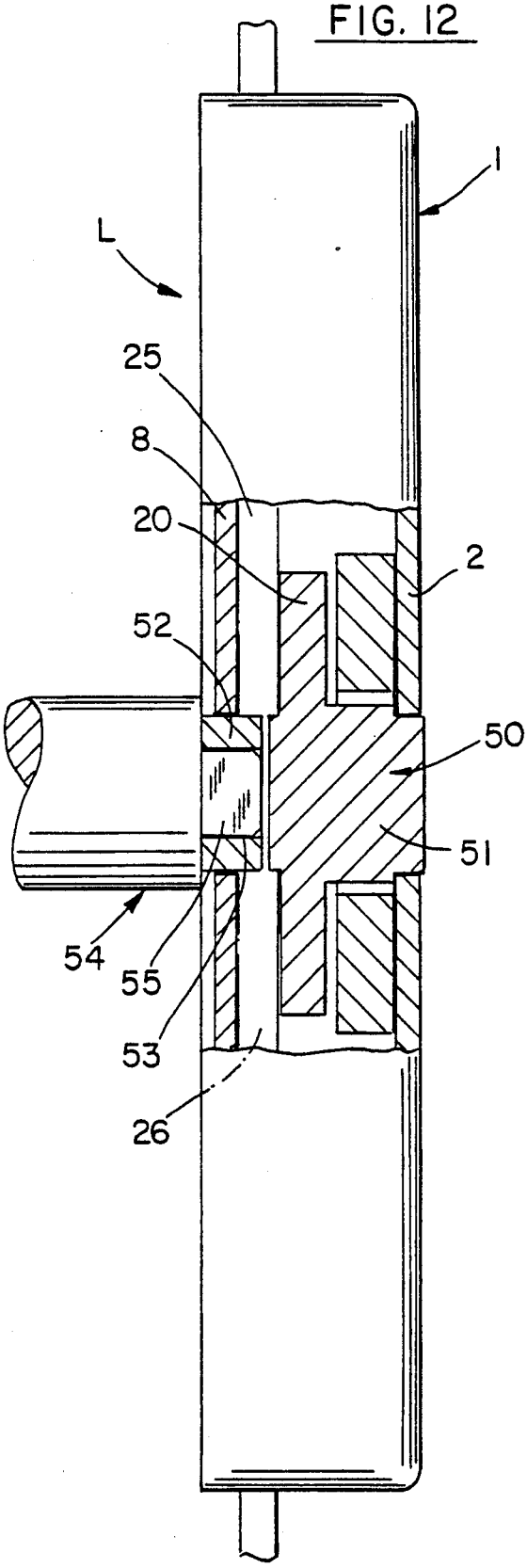
FIG. 12 is a view corresponding to FIG. 11, in which a joint between two nut parts has been removed by the application of heat thereto.

According to the third embodiment illustrated in FIGS. 11 and 12, the lock corresponds substantially to the lock according to the first embodiment. However, it has a lock actuating nut 50 of a different construction. The lock actuating nut 50 is composed of two nut parts 51 and 52. One nut part 51 is positioned in the lock base 2 and is formed integrally with the collar 20. No square opening is formed in this nut part 51. The other nut part 52 is positioned in the lock cover 8 and is formed with a square opening 53 for an offset square peg 55 of an actuating element 54.

The two nut parts 51 and 52 are joined together at a joint 56 by means of a fusible adhesive, soft solder point, etc.

The nut part 52 by a lock cylinder (not shown) which can be assembled in a door in the same manner as the lock cylinder 17 is assembled with the door D in FIG. 1. Proper lock actuation necessitates prior removal of the lock cylinder using the associated key. The lock-actuating element 52 is then accessible so that the actuating element 54 can be placed into engagement with the lock-actuating element to facilitate movement of the slide bolt 29.

If, on the other hand, a break-in is attempted using a miniature welding torch, then the action of the heat will cause the joint 56 to flow and thereby separate the coupling of the nut part 51 to the nut part 52. This means that the nut part 52 can then be rotated relative to the other nut part 51. Rotation of the nut part 52 with the actuating element 54 or a different opening tool does not therefore lead to actuation of the lock, as can be seen from FIG. 12.

Instead, as shown, a lock equipped with only a slide bolt could also have the same equipment. It is basically constructed such that the lock-actuating element or elements is or are blocked by the action of the heat, preventing the lock from being opened later.

I claim:

1. A lock with facility for preventing unauthorised entry, which comprises:

a lock cylinder removably mounted within a door;

a bolt element attached to the door for movement relative thereto;

moving means for moving the bolt element;

the moving means located adjacent the lock cylinder and concealed thereby;

the lock cylinder being normally operable to facilitate removal of the lock cylinder from the door to expose the moving means;

an actuating element for facilitating selective operation of the moving means to move the bolt element subsequent to removal of the lock cylinder from the door;

fusible means for operatively connecting the moving means to the bolt element at temperatures below a prescribed temperature and for rendering the bolt element inoperable by the moving means at temperatures at or above the prescribed temperature.

2. The lock as set forth in claim 1 wherein the fusible means is soft solder.

3. The lock as set forth in claim 1, which further comprises:

precluding means positionable in a path of movement of the bolt element for precluding movement of the bolt element;

urging means for normally urging the precluding means into a position in the path of movement of the bolt element;

withdrawing means removably attached to the urging means and engageable by the actuating element for withdrawing the precluding means from the path of movement of the bolt element upon engagement with the bolt element; and wherein the fusing means acts as a retaining and releasing means for attaching the withdrawing means to the urging means at temperatures below the prescribed temperature and for releasing the withdrawing means from the urging means when subjected to temperatures at or above the prescribed temperatures.

4. The lock as set forth in claim 3, wherein the urging means is a leaf spring, the precluding means is an arresting pin attached to the leaf spring and the retaining and releasing means is a fusible material for attaching the withdrawing means to the leaf spring.

5. The lock as set forth in claim 4, wherein the moving means includes a lock actuating nut coupled to the bolt element for driving movement of the bolt element and positioned for reception of the actuating element and wherein the withdrawing means is a peg attached to the leaf spring by the fusible material and extendable into an opening of the lock actuating nut for engagement with the actuating element within the opening.

6. The lock as set forth in claim 5, wherein the free end of the leaf spring is formed with an open fork and the peg is attached to the leaf spring about the open fork.

7. The lock as set forth in claim 6, wherein the fusible means is a soft solder.

8. The lock as set forth in claim 1, wherein the fusible means is a fusible belt which links the moving means to the bolt element.

9. The lock as set forth in claim 8, wherein the moving means includes a pinion coupled to the bolt element and the fusible belt to facilitate movement of the bolt element.

10. The lock as set forth in claim 1, wherein the moving means includes a first part and a second part and the fusible means is located between the first part and the second part.

11. The lock as set forth in claim 10, wherein the fusible means is soft solder.

* * * * *